US008567363B1

(12) United States Patent
Christensen

(10) Patent No.: US 8,567,363 B1
(45) Date of Patent: Oct. 29, 2013

(54) MOTORCYCLE ROCKER ARM STAND APPARATUS

(75) Inventor: Craig A. Christensen, Yuba City, CA (US)

(73) Assignee: Craig A Christensen, Yuba City, CA (US)

( * ) Notice: Subject to any disclaimer, the term of this patent is extended or adjusted under 35 U.S.C. 154(b) by 25 days.

(21) Appl. No.: 13/506,242

(22) Filed: Apr. 6, 2012

(51) Int. Cl.
*F01L 1/18* (2006.01)

(52) U.S. Cl.
USPC ..... 123/90.39; 74/559

(58) Field of Classification Search
USPC ..... 123/90.39, 90.16; 74/559, 569
See application file for complete search history.

(56) References Cited

U.S. PATENT DOCUMENTS 2,522,326 A * 9/1950 Winter, Jr. ..... 74/519

* cited by examiner

*Primary Examiner* — Zelalem Eshete

(57) ABSTRACT

A motorcycle engine rocker arm stand having a pair of rocker arm assemblies spaced a distance "D" from each other effective to increase the "rocker arm ratio" and therefore the horsepower output of the engine. Each rocker arm assembly includes a first arm portion and a second arm portion oriented along an axis disposed at an acute angle to the axis of the first arm portion. Each rocker arm further includes a roller contact for engagement with the intake valve stem of the engine and an axially adjustable contact member for engagement with the engine's push rod. The axially adjustable contact member axis is disposed at a second acute angle with respect to the axis of the first arm portion.

10 Claims, 6 Drawing Sheets

FIG 1
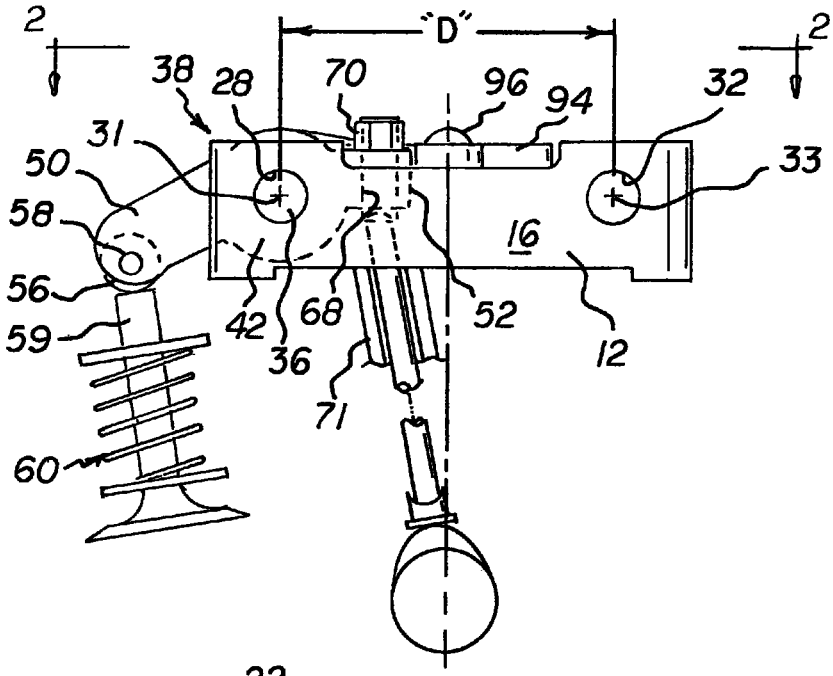
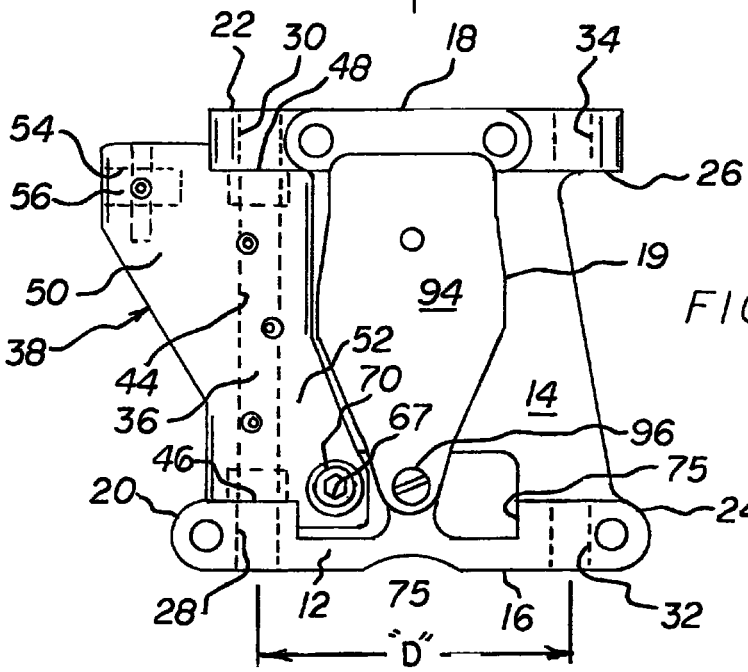
FIG 2

FIG 4
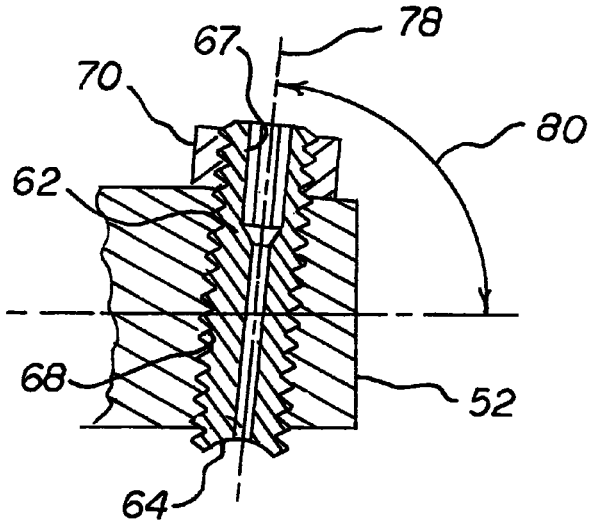
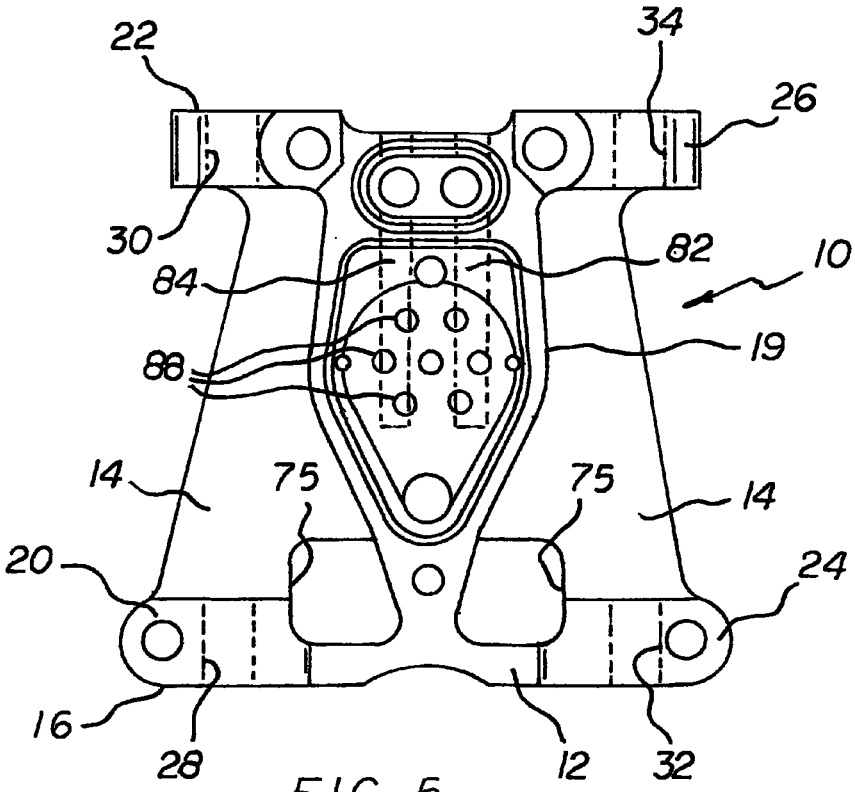
FIG 5

FIG. 8
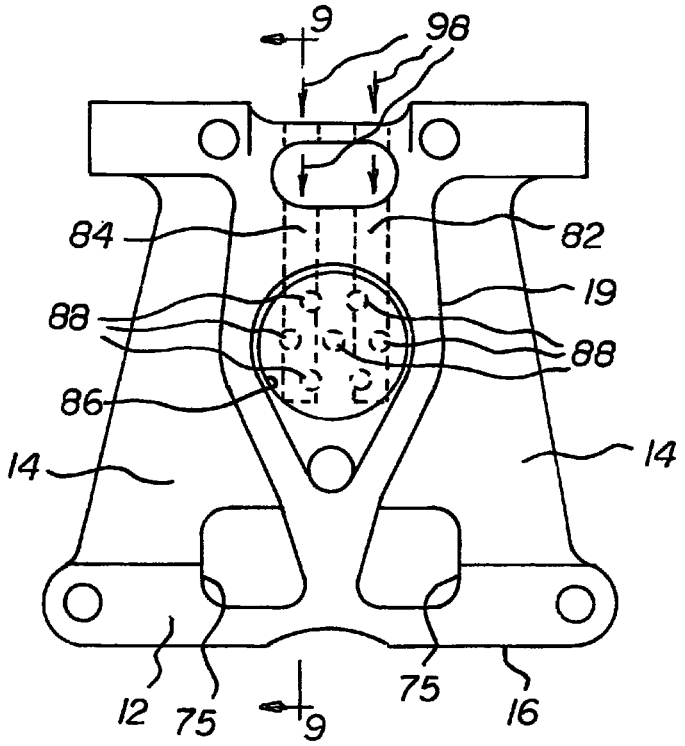
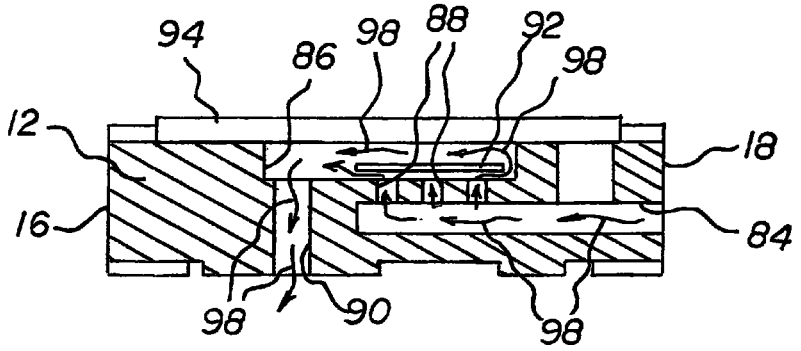
FIG. 9

MOTORCYCLE ROCKER ARM STAND APPARATUS

FIELD OF THE INVENTION

The present invention relates generally to motorcycle engines, and more specifically, to improvements in the rocker arm stand of a motorcycle engine such as the 2-stroke "Twin Cam 88" over-head valve engine used on the enormously popular Harley-Davidson™ motorcycle.

SUMMARY OF THE INVENTION

The novel rocker arm stand apparatus of the present invention is a dramatically improved replacement for the stock rocker arm stand provided on OEM motorcycles, and more particularly, for the rocker arm stand provided as original equipment on the aforementioned Harley-Davidson motorcycle.

In accordance with the present invention, the improved rocker arm stand apparatus disclosed herein has rocker arm pivot axes that are located closer to one another in comparison to the distance between the rocker arm axes in the prior art or stock rocker arm stand. By locating the rocker arm pivot axes closer together and additionally providing uniquely configured rocker arms, as further taught only by the present invention, it is possible to increase the "rocker arm ratio" of each arm. The "rocker arm ratio" is defined as the effective length of the arm portion contacting the corresponding engine intake valve stem divided by the effective length of the arm portion contacting the corresponding engine push rod. By increasing the rocker arm ratio, in accordance with the present invention, the horsepower output of the motorcycle engine is increased. It is impossible to increase the "rocker arm ratio" in stock (prior art) rocker stands by reducing the distance between the arm pivot axes because any such modification there would result in interference with the push rod tubes provided in the engine of the stock motorcycle.

Another advantage provided by the present invention is the use of a distal roller bearing on the rocker arm portion engaging the valve stem thereby reducing friction and wear of these parts. Still another advantage of the present invention is the provision of an axially adjustable push-rod engagement or contact member having a cup-like bottom end defining an arcuate-shaped push rod contact surface on the rocker arm portion engaging the top portion of the conventional cam driven push rod. This construction enables precise adjustment of valve lift to maximize engine efficiency. No such adjustment feature is provide on the stock prior art rocker arm stand.

Yet still another advantageous feature of the present invention is the provision of an increased-capacity pressure relief chamber integrated with the rocker arm stand.

The foregoing and additional features and advantages of the invention will become even more apparent from the following detailed description given below.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a front view in elevation showing schematically the improved rocker arm stand apparatus according to the present invention in assembly with a conventional valve assembly, push rod and cam.

FIG. 2 is a top view taken along line 2-2 of FIG. 1.

FIG. 4 is an enlarged fragmentary vertical cross-section of the axially-adjustable push-rod engagement portion of the rocker arm on the rocker arm stand of the present invention shown in FIG. 6.

FIG. 5 is a top view of the rocker arm stand taken along line 5-5 of FIG. 3 showing the built-in crank case pressure-relief portion thereof.

FIG. 8 is a top plan view of the rocker arm stand of the invention depicting the flow of high-pressure crank case gas therethrough.

FIG. 9 is a cross-sectional view taken along line 9-9 of FIG. 8.

DESCRIPTION OF THE PREFERRED EMBODIMENT

Figure 3:
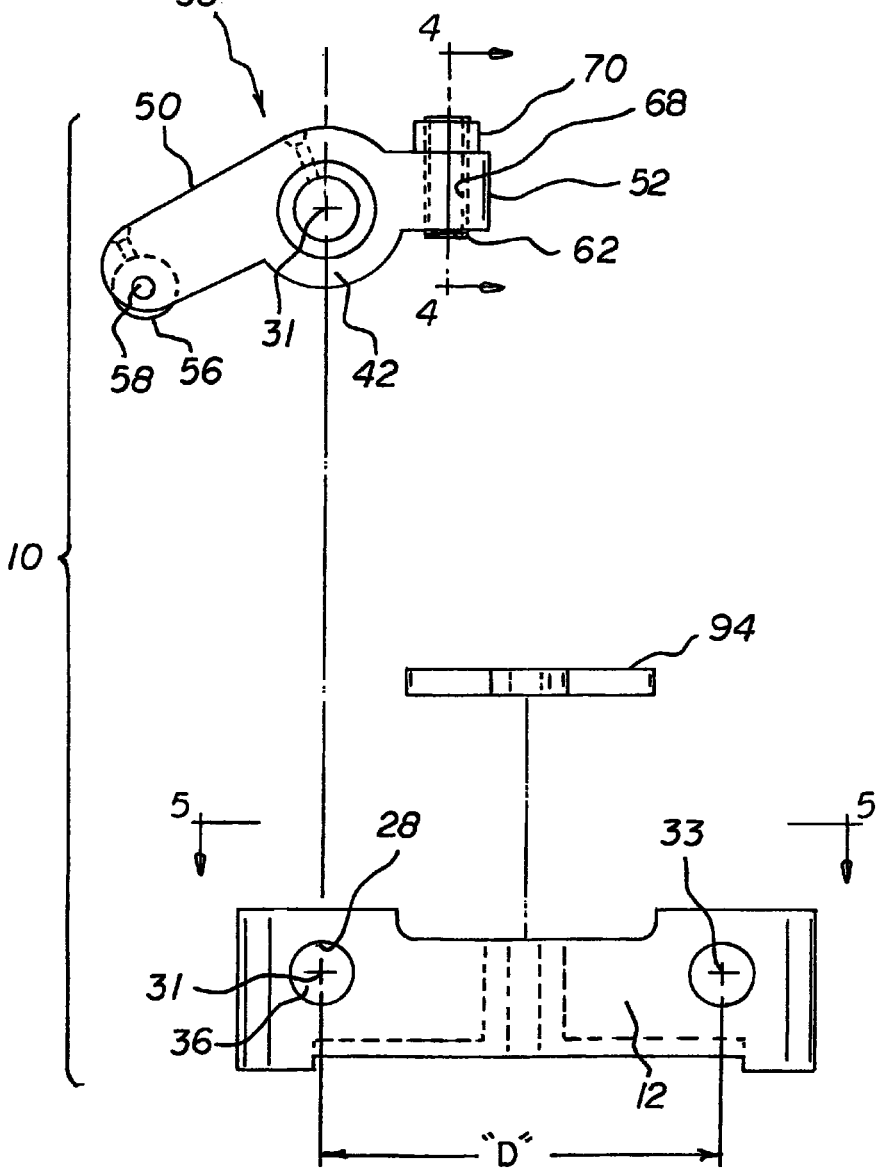
FIG. 3 is an exploded assembly of the rocker arm stand of FIG. 1.

With reference to the drawings, the new and improved rocker arm stand apparatus of the present invention suitable for use on a twin cam motorcycle engine such as found in Harley-Davidson™ motorcycles, for example, is represented generally by reference sign 10. The rocker arm stand 10 of the present invention is intended to replace the stock rocker arm stand on OEM motorcycles such as that, for example, provided on a Harley-Davidson Twin Cam 88 type. Rocker arm stand 10 is in the form of a one-piece rigid body member 12 comprising a substantially flat floor or base member portion 14 having opposed upstanding end walls 16, 18 and an upstanding somewhat coffin-shaped central body portion 19 substantially as shown in FIGS. 1, 2 and 5. As will be explained in further detail below, central body portion 19 defines a chamber serving as a crank case pressure relief chamber.

Opposed upstanding end walls 16 and 18 define pairs of opposed rocker arm support bosses 20, 22 and 24, 26, respectively. Each boss in turn includes a suitable opening 28, 30 and 32, 34 respectively, for receiving and supporting a fixed axle and corresponding rocker arm assembly in a somewhat raised position above the floor portion 14 of rocker stand body portion 12. The confronting openings 28 and 30 define a first rocker arm axis 31 whereas the confronting openings 32 and 34 define a second rocker arm axis 33 with axes 31 and 33 being parallel to each other and spaced apart a distance "D." See FIG. 1.

It is to be understood that in the preferred embodiment, rocker arm stand 10 is adapted to be utilized on a twin cam engine and accordingly, there is provided two such rocker arm assemblies, substantially identical to each other, suitably mounted on opposite sides of the rocker stand 10, respectively, in a mirror-image fashion. However, for the sake of simplicity of presentation only one such rocker arm assembly 38 and its associated axle 36 mounted in openings 28, 30 in bosses 20, 22 will be described below in detail and shown in the drawings.

That being said, as depicted in FIGS. 1 and 2, rocker arm assembly 38 is suitably rotatably mounted for rocking or pivoting motion on corresponding fixed axle 36 about axis 31 defined by axle 36 mounted in openings 28, 30 located in bosses 22, 24, respectively. Rocker arm assembly 38 includes a central portion 42 through which axial through-opening 44 extends from one end 46 to a second opposed end 48. Axle 36 is deposed in axial through-opening 44 and is suitably fixedly received in openings 28, 30 such that the rocker arm assembly is supported on rocker stand 10 for rocking pivoting motion about axis 31. As mentioned, a similar second rocker arm assembly (not shown) is mounted in mirror-image fashion for rocking or pivoting rotation about second rocker arm axis 33. Extending laterally or radially from central portion 42 with respect to axis 31 is a first arm portion 50 proximal to end 48 whereas extending radially or laterally oppositely from central portion 42 with respect to axis 31 is a second arm portion 52 proximal to opposed end 46.

First arm portion 50 of rocker arm assembly 38 includes a bifurcation or slot 54 for housing a cylindrically-shaped valve stem contact roller 56 rotatably mounted on a fixed axle or pin 58 substantially as depicted in FIGS. 1-3. As schematically depicted in FIG. 1, when the rocker stand 10 is fastened in place in its intended position on top of a motorcycle engine block (not shown), the contact roller 56 engages the top of a conventional intake valve stem 59 which in turn is suitably mounted in a conventional coil spring assembly 60 in the intake valve portion of the engine block as is well known in the art. Hence, the first arm portion 50 of the rocker arm assembly is the intake valve engagement portion of the rocker arm assembly 38.

Second or opposed arm portion 52 includes an axially adjustable push-rod engagement or contact member 62 having a cup-like bottom end defining an arcuate-shaped push rod contact surface 64 for engaging the top of a conventional cam driven push rod 66. The top of the contact member 62 (FIG. 4) includes an hexagonal socket 67 for receiving a complimentary wrenching tool (not shown). The shank of contact member 62 suitably is externally threaded so as to be threadedly supported in a complimentary threaded bore or through opening 68 in second arm portion 52. By this arrangement, the fixed position of contact member bottom end arcuate contact surface 64 can be axially adjusted, i.e. advanced up or down axially in through opening 68 if and as when a complimentary wrenching tool is inserted into the hexagonal socket 67 and rotated one way or the other. A suitable locking collar or nut 70 is threadedly mounted on the top portion of contact member 62 substantially as depicted in FIG. 4 and may be rotatively loosened to permit such axial adjustment of contact member 62 (and arcuate surface 64) in through opening 68 and relative to the second arm portion 52. The locking collar 70 subsequently can be tightened after suitable desired adjustment has taken place to affix (lock) the contact member 62 (and contact surface 64) in its adjusted axial position in the opening 68 of the second arm portion 52. Such adjustment as will be discussed in more detail below is effective to adjust the valve lift of the intake valve of the engine. Thus, the second arm portion 52 of rocker arm assembly 38 is the push rod engagement portion of the rocker arm assembly 38. In this regard, it will be noted that push rod 66 travels up and down through a suitable protective tube 71 when driven cyclically by cam 73 as is well known. Suitable openings 75 are provided in the base of rocker arm stand 12 to permit the top of the push rod 66 to maintain engagement with contact 62 and the latter's arcuate contact surface 64.

It is known that power output of the engine of the type concerned herein may be increased by increasing the so-called "rocker arm ratio," namely the ratio of the length of the first arm portion of each rocker arm assembly relative to its second arm portion as measured with respect to the rocker arm's corresponding pivot axis. This may done in the context of the rocker stand of the type concerned herein merely by locating the pivot axes 31, 32 of the two opposed rocker arm assemblies closer to one another and changing the dimensions of the rocker arm portions accordingly. However, the only way to do this with a conventional rocker arm stand (as used say on an OEM Harley-Davidson motorcycle) is to shorten the second arm portion (push rod engagement portion. But if this were done, the push rods 66 would interfere with and rub against the sidewalls of the tubes 71 conventionally used to protect the push rods.

In accordance with an important feature of the present invention, the distance "D" between the rocker arm axes 31 and 33 is reduced, the length of the first arm portion 50 of the rocker arm assembly is increased, the length of the second arm portion 52 is decreased, and the overall length of the rocker arm assembly measured from the valve-stem engagement point to the push rod engagement point is maintained the same with respect to the prior art rocker stand, all without causing interference with the conventional rocker arm tubes 71.

The foregoing surprisingly is accomplished in accordance with the present invention by providing a rocker arm assembly 38 having a unique geometry as will be explained in connection with FIG. 6 below. As a result of the present invention, the ratio of the length of the first arm portion 50 of and on each rocker arm assembly relative to the length of its second arm portion 52 as measured with respect to the rocker arm pivot axis 31, i.e. the "rocker arm ratio" is increased thereby increasing the horsepower output of the engine.

Figure 6:
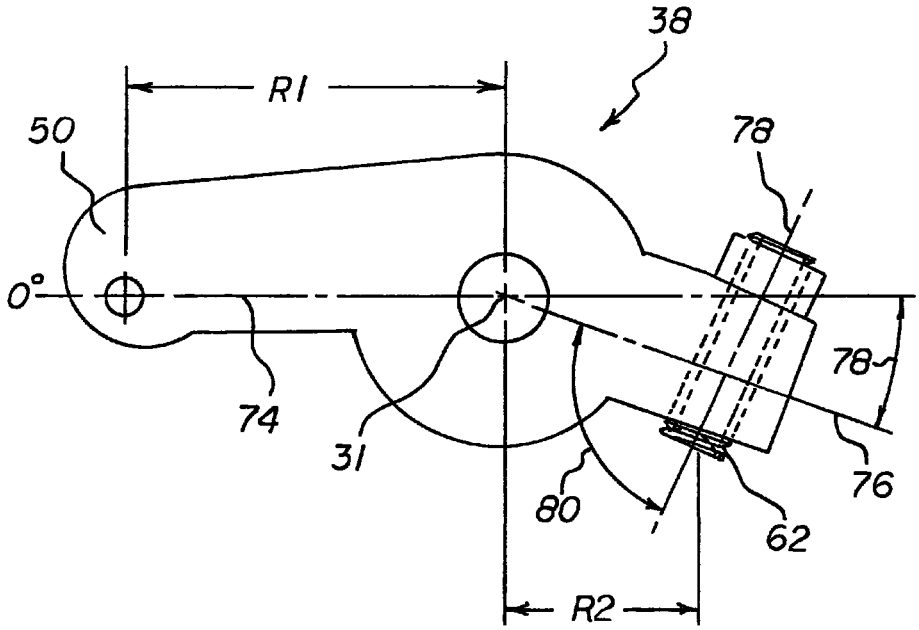
FIG. 6 is an enlarged schematic depiction illustrating the unique geometrical configuration of the rocker arm utilized in the rocker arm stand according to the present invention.

The unique geometry of the rocker arm assembly 38 responsible for enabling the "rocker arm ratio" to be increased as contemplated by the present invention is depicted in detail in FIG. 6 where it will be observed first arm portion 50 extends along a longitudinal axis 74 (first longitudinal axis 74) perpendicular to rocker arm axis 31 and second arm portion 52 extends along a longitudinal axis 76 (second longitudinal axis 76) perpendicular to rocker arm axis 31. Moreover, first arm portion 50 of rocker arm assembly 38 is oriented at an obtuse angle with respect second arm portion 52 whereupon axes 74 (first longitudinal axis 74) and 76 (second longitudinal axis 76) make an angle 78 (first-to-second acute angle 78) with respect to each other.

In FIG. 6, the lateral extent of first arm portion 50 is represented by length R1 whereas the lateral extent of second arm portion 52 is represented by length R2. Additionally, as shown in FIG. 4, the central imaginary axis (third longitudinal axis 87) of contact member 62 and through opening 68 (they are parallel and coincident) is canted at an angle relative to axis 76 (second longitudinal axis 76) of second arm portion 52 which angle is represented by reference numeral 80 (second-to-third acute angle 80).

Without limiting the present invention and merely for purposes of illustration, the following parameters are preferred in carrying out the present invention. The distance "D" (FIG. 1) (arrived at by locating the rocker arm pivot axes closer together than they are in a stock OEM Harley) can be equal to about 3.280 inches whereas in a prior art OEM rocker stand this same dimension is about 3.480 inches. With respect to each rocker arm assembly 38, the length of the first arm portion 50 can be lengthened to about 1.475 inches and the length of the second arm portion 52 can be shortened to about 0.775 inches maintaining the overall length at about 2.250 inches (in an OEM or stock rocker stand, these dimensions are about 1.375 inches and about 0.875 inches, respectively). The angle 78 (first acute angle) between axes 74 (first longitudinal axis 74) and 76 (second longitudinal axis 76) can be about 20° with respect to each other whereas the angle of central imaginary axis 78 can be canted or tilted about 5° relative to a normal to axis 74 (second acute angle); hence angle 80 can be about 85° (second acute angle between axis 78 and axis 76).

Figure 7:
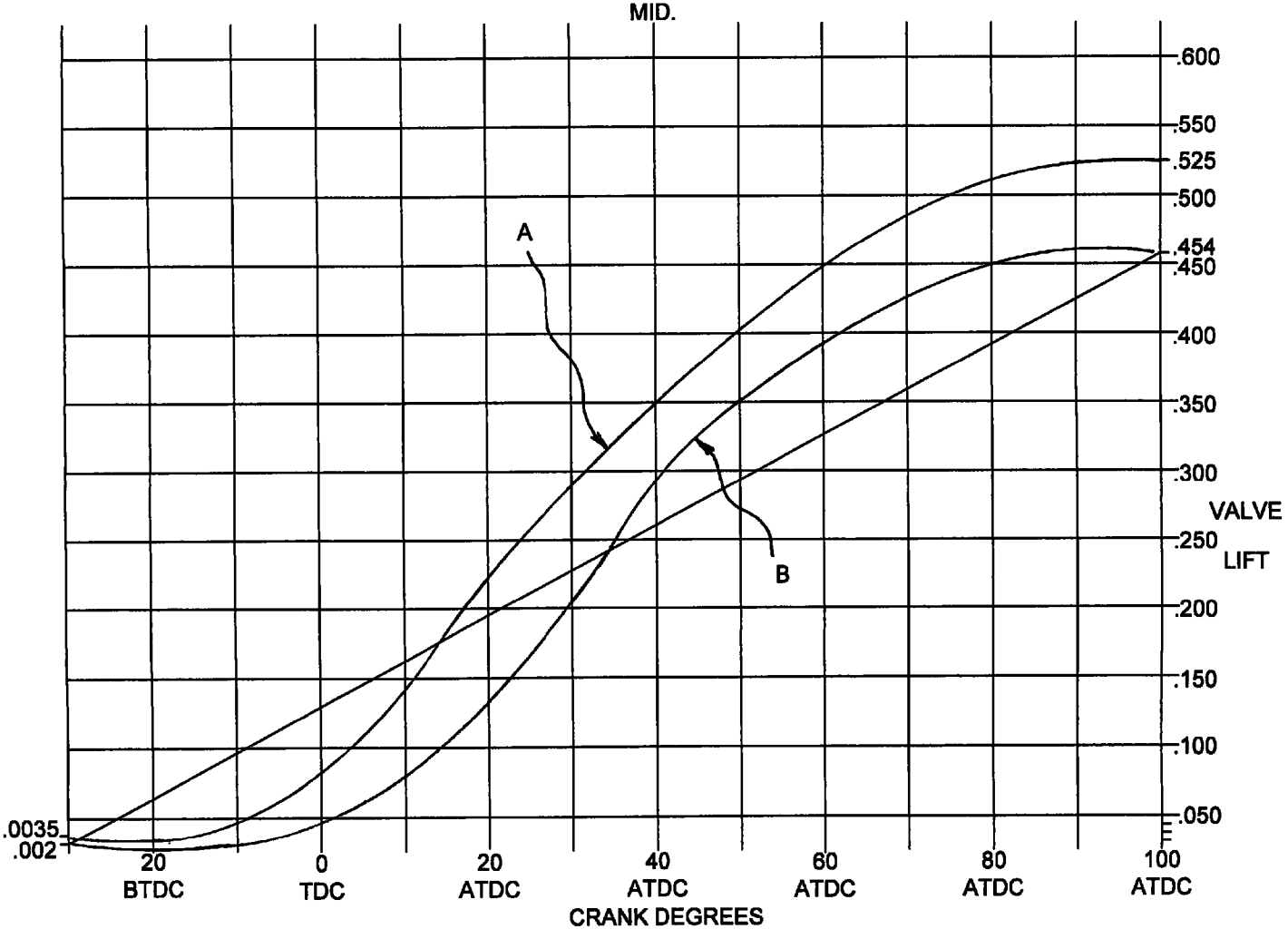
FIG. 7 is a graphical depiction of intake valve lift vs. crank position illustrating the advantageous effect of using the rocker arm stand according to the present invention.

An important advantage of the unique geometry of the rocker arm assembly 38 described hereinabove is that the opening of the intake valve of the engine is "accelerated" soon after the cam of the engine passes through top dead center (TDC). This is graphically and dramatically depicted in FIG. 7 which shows the valve lift as a function of cam position. With the present invention, valve lift is indicated by curve A whereas curve B represents the valve lift of the engine utilizing the prior art stock rocker stand and rocker arm assembly. Curve A shows that when utilizing the present invention, the intake valve is opened sooner and faster pulling more air/fuel mixture into the cylinder and increasing power output. Curve A of the graph of FIG. 7 further demonstrates that the present invention is capable of increasing the maximum valve lift compared to a stock Harley engine (Curve B), and that at maximum valve lift, the intake valve dwells longer; hence the effective "rocker arm ratio" using the present invention is not only larger to begin with, but is somewhat variable during the intake cycle increasing the efficiency of the engine and contributing to its greater horsepower output. By using the rocker arm stand of the present invention, it is believed that an increase in horsepower output over a stock Harley Twin Cam 88 in the range of about 4% to about 8% can be achieved without any need for relatively expensive cam or cam shaft modification.

As substantially depicted in FIGS. 8 and 9, a completely integrated pressure relief chamber is "built-in" to the rocker arm stand 10 of the present invention. It is not a separate "bolted-on" component as contained in the prior art. The centrally disposed somewhat coffin-shaped chamber 19 includes a pair of blind flow passages 82, 84 communicating with an annular-shaped valve chamber 86 through a series of vent holes 88 which valve chamber in turn communicates with an exhaust vent passage 90. A Neoprene flapper valve 92, preferably of circular or round shape is seated in the chamber in such a way as overlie vent holes 88. The flapper valve 92 is normally maintained in place by cover 94 removably fastened in place on the rocker stand by a suitable bolt fastener 96 (FIG. 1). When the pistons of the engine move downwardly in their respective cylinders, the gas in the crankcase is compressed. To provide a safe relief for this high pressure compressed gas, the high pressure gas indicated by arrows 98 flows through the passages 82, 84, then through the vent holes 88 impinging on the underside of the flapper valve 92 in chamber 86, beyond the flapping valve 92, exiting through the exhaust vent passage 90. The flow capacity of the integrated pressure relief chamber described above has about 30% more capacity than a stock OEM pressure relief chamber.

The rocker stand 10 of the present invention can be machined from a single block of high-strength, light-weight metal, with 2024 aluminum being mostly preferred.

In use, the rocker arm stand 10 of the present invention may serve as an after-market replacement part capable of being be substituted for the stock rocker arm stand provided as OEM equipment on motorcycles, and particularly on the Harley-Davidson Twin Cam 88 type.

The foregoing detailed description is considered as illustrative only of the principles of the invention. Numerous modifications and changes will readily occur to those skilled in the art and therefore, it is not desired to limit the invention to the exact construction and operation shown and described. Accordingly, all suitable modifications and equivalents falling within the broad scope of the subject matter described above may be resorted to in carrying out the present invention.

What is claimed as being new and desired to be protected by Letters Patent of the United States is as follows:

1. A rocker arm stand apparatus for a 2-stroke over-head valve internal combustion engine comprising:

a rocker arm stand body, said rocker arm stand body having a rocker arm stand floor portion, first and second pairs of rocker arm support bosses connected to said rocker arm stand body floor portion, said first and second pairs of rocker arm support bosses extending oppositely with respect to each other on said rocker arm stand body floor portion, said first and second pair of rocker arm stand support bosses defining respective first and second pairs of confronting longitudinally aligned openings therein, first and second rocker arm axles mounted respectively in said first and second longitudinally aligned pairs of confronting longitudinally aligned openings, first and second rocker arm assemblies mounted on each of said first and second rocker arm axles respectively, each said first and second rocker arm assemblies comprising an intake valve stem engagement portion and a push rod engagement portion respectively, said intake valve stem engagement portion and said push rod engagement portion being longitudinally spaced with respect to each other along said first and second rocker arm axels, respectively, wherein said intake valve engagement portion has a first lateral extent with respect to its corresponding axle, wherein said push rod engagement portion has a second lateral extent with respect to its corresponding axle, wherein said first and second rocker arm axles are spaced from each other a distance "D," and wherein said distance "D" is less than about 3.480 inches.

2. The apparatus of claim 1 wherein said distance "D" is about 3.280 inches.

3. The apparatus of claim 1 wherein the ratio of said first lateral extent to said second lateral extent is defined as the "rocker arm ratio," and said "rocker arm ratio" is about 1.9.

4. The apparatus of claim 1 further including a crankcase pressure relief assembly integrated into said rocker arm stand, wherein said crankcase pressure relief assembly comprises:

a chamber portion formed on said rocker arm stand floor portion, a pair of blind flow passages for communication with the crankcase od said internal combustion engine, a series of vent holes in said chamber portion in communication with said pair of blind flow passages, a flapper valve in said chamber portion in registration with said series of vent holes, wherein a portion of said chamber portion is located above said flapper valve, and wherein exhaust vent passages are provided in communication with said portion of said chamber portion located above said flapper valve.

5. The apparatus of claim 4 wherein said chamber portion includes upstanding end walls.

6. A rocker arm assembly apparatus for use in a 2-stroke over-head valve internal combustion engine, said rocker arm assembly apparatus comprising:

a first arm portion, a second arm portion, said first arm portion being fixed relative to said second arm portion along a longitudinal axis, said longitudinal axis defining the pivotal axis of said rocker arm assembly, said rocker arm assembly being pivotally mounted for rotation on an axle adapted to be fixedly supported on a rocker arm stand, said axle being coincident with said longitudinal axis, said first arm portion including a distal valve stem engagement portion, said second arm portion including a distal reception bore for receiving a push rod contact member, and wherein said first arm portion is oriented along a first arm axis extending radially from said longitudinal axis, wherein said second arm portion is oriented along a second arm axis extending radially from said longitudinal axis, and wherein said second arm axis is oriented with respect to said first arm axis at a first acute angle.

7. The apparatus of claim 6 wherein said second arm portion includes a distal end portion reception bore, a push rod contact member being located in said distal end portion reception bore, said push rod contact member defining a third arm axis, and wherein said third arm axis intercepts said second arm axis at a second acute angle.

8. The apparatus of claim 6 wherein said first arm portion terminates in a contact roller for engaging said internal combustion engine intake valve stem.

9. The apparatus of claim 7 wherein said push rod contact member is adjustably axially supported in said distal end portion reception bore.

10. The apparatus of claim 6 wherein said internal combustion engine is a motorcycle engine.

* * * * *